United States Patent [19]

Perr

[11] Patent Number: 4,721,247

[45] Date of Patent: Jan. 26, 1988

[54] HIGH PRESSURE UNIT FUEL INJECTOR

[75] Inventor: Julius P. Perr, Columbus, Ind.

[73] Assignee: Cummins Engine Company, Inc., Columbus, Ind.

[21] Appl. No.: 909,208

[22] Filed: Sep. 19, 1986

[51] Int. Cl.[4] ..... F02M 45/00; F02M 53/04; F02M 55/00

[52] U.S. Cl. ..... 239/91; 239/95; 239/125

[58] Field of Search ..... 239/88–96, 239/124–127, 533.4, 533.5

[56] References Cited

U.S. PATENT DOCUMENTS

| | | | |
|---|---|---|---|
| 4,281,792 | 8/1981 | Sisson et al. | 239/91 X |
| 4,410,137 | 10/1983 | Perr . | |
| 4,410,138 | 10/1983 | Peters et al. . | |
| 4,420,116 | 12/1983 | Warlick | 239/95 |
| 4,441,654 | 4/1984 | Peters . | |
| 4,463,725 | 8/1984 | Laufer et al. | 239/95 X |
| 4,463,901 | 8/1984 | Perr et al. | 239/95 |
| 4,471,909 | 9/1984 | Perr . | |

*Primary Examiner*—Andres Kashnikow

*Attorney, Agent, or Firm*—Sixbey, Friedman & Leedom

[57] ABSTRACT

A fuel injector of the open nozzle type, which is capable of achieving SAC pressures in excess of 30,000 psi during injection. The injector assembly of the preferred embodiments includes a plunger assembly having three plungers arranged to form a hydraulic, variable timing fluid chamber between upper and intermediate plungers and an injection chamber below a lower plunger. To prevent leakage from the injection chamber, the fuel supply passage is provided, along with the injection chamber, within a one-piece injector cup and a predetermined minimum seal length, at commencement of injection, between a land portion of an injection plunger and a wall surface defined by a bore of the injector within which it reciprocates is coordinated to the dimensions of the bore below the land and a predetermined maximum solid fuel height for the injector to result in the minimum seal length being at least one-half of the maximum solid fuel height. To obtain an increase in SAC pressures under low speed operating conditions without exceeding pressure capabilities under high speed conditions, some embodiments have valve arrangements for draining timing fluid from the timing chamber whenever the pressure of the timing fluid therein exceeds a predetermined value.

21 Claims, 11 Drawing Figures

HIGH PRESSURE UNIT FUEL INJECTOR

DESCRIPTION

1. Technical Field

This invention relates to fuel injectors and in particular unit fuel injectors especially those of the type having an open nozzle and a reciprocating injection plunger that is mechanically actuated by an engine cam shaft.

2. Background Art

As the needs for higher levels of pollution control and increased fuel economy have called for substantially improved fuel supply systems, unit fuel injectors, of the initially mentioned type have been developed which are designed to provide a fuel injector of simplified design, thereby providing cost reductions, while at the same time providing reliable and precise control of independently variable fuel injection timing and quantity parameters, as is necessary from a fuel economy and emissions abatement standpoint. The following patents owned by the assignee of the present application relate to such unit injectors and are representative of the prior art unit and injectors that the present invention is intended in a further development of:

Perr U.S. Pat. No. 4,471,909
Peters U.S. Pat. No. 4,441,654
Warlick U.S. Pat. No. 4,420,116
Peters et al U.S. Pat. 4,410,138
Perr U.S. Pat. No. 4,410,137.

All of the above listed patents represent fuel injectors of the type having an open nozzle and a reciprocating injection plunger mechanically actuated by an engine camshaft.

The first two of the above listed patents, Perr U.S. Pat. No. 4,471,909 and Peters U.S. Pat. No. 4,441,654 are basically of a similar design which is capable of performing a variety of functions previously associated only with more complex designs. This is achieved by minimizing the number of fluid flow passages, most of which are arranged in a generally radial direction to decrease manufacturing costs, and by constructing the plunger and its relationship with respect to feed and drain ports in order to perform the multiple functions of metering fuel into the injector, injecting of fuel from the injector to an engine cylinder, scavenging of gases and cooling.

The remaining three of the five above listed patents disclose unit injectors that also, are basically similar in design. These injectors differ from the injectors of the first two mentioned patents in that a plunger assembly comprised of inner (lower) and outer (upper) plunger sections replaces the single plunger in order to provide hydraulically controlled timing, among other things.

Even though fuel injectors of the above noted type have proven to be very effective, reliable, and economical, impending further restrictions on the levels of hydrocarbons, nitrogen oxides, and particulate mass in vehicle emissions pose problems in attainment, particularly in a cost effective and fuel efficient manner. To avoid using expensive, hard to maintain after treatments like catalysts, requires dealing with the pollutants at the source, i.e., in the combustion space. This means increasing the efficiency of the combustion process which, in turn, means injection of the fuel at considerably higher pressures than have heretofore been attained, particularly during low speed operation. For example, in the above listed patents, the injection chamber is formed in an injector cup that constitutes the bottom-most element of a multi-piece injector body and fuel is supplied to the injection chamber via a supply passage formed in another injector body element. In such an arrangement, clamped high pressure joints are present which limit the injection pressure capabilities of the fuel injector to SAC pressures (i.e., pressure of the fuel in the injection chamber just in front of the injector spray holes) to under 20,000 psi.

Furthermore, another pressure limitation is imposed by the fact that, in operation of such injection systems, injection commences (i.e., the plunger reaches the solid fuel height within the injection chamber) very shortly after a sealing portion of the plunger has blocked the supply port. As a result, the seal length of the plunger (i.e., the length of the sealing surface of the plunger below the fuel supply orifice), which is typically 0.4 mm., presents an interface which will leak if very high SAC pressure levels occur, such as those over 30,000 psi. Also, the presence of the supply orifice in close proximity to the region of very high pressure cyclically creates stress risers that result in fatigue effects which shorten the life of the injector.

Other constructional features of unit injectors of these three patents exist which would pose problems if such injectors were to be used under operational conditions of very high SAC pressures. For example, the use of hollow plungers, the interior of which is exposed to highly pressurized fluid poses a problem because of a dialation effect (the pressure of the fluid within the hollow plunger causes expansion thereof) which, in conjunction with the exceptionally fine tolerances to which the outer diameter of the plungers are matched to the bore of the injector body within which they move, can lead to excessive wear and/or jamming occurring at this interface. Additionally, since the timing chamber, in the arrangement of these patents, is at the same pressure as the injection chamber, going to very high SAC pressures will result in problems associated with a corresponding increase in the timing pressures. These problems involve, not only sealing problems, but modification of the springs against which the timing fluid acts.

In addition to the above-noted "open nozzle" unit fuel injectors, unit fuel injectors of a "closed nozzle" type exist which function on difference operational principles. Perr et al U.S. Pat. No. 4,463,901 represents a unit fuel injector having independently controlled timing and metering of this type which utilizes a plunger assembly having three plungers. Apart from the fact that the unit fuel injector as disclosed in this patent is not operational as an open nozzle system, it too would be subject to many of the same problems (such as leakage and dilation effects) as just described, if such a system were to be used with SAC pressures in excess of 30,000 psi. In this regard, this patent discloses, as significant, the fact that it is able to achieve SAC pressures of approximately 16,000 or 17,000 psi in comparison to the SAC pressures achieved by more conventional injector designs of approximately 11,000 psi.

The present invention, as noted initially, relates to unit fuel injectors of the "open nozzle" type as opposed to injectors of the "closed nozzle" type and seeks attainment of SAC pressures twice that of U.S. Pat. No. 4,463,901 and three times that of the more conventional injector designs referred to therein.

Still another factor to be taken into consideration in the pursuit of higher emission abatement, particularly that of particulant matter and nitrogen oxides in diesel engines, via increased injection pressures, is the question of how to deal with low speeds operational conditions. That is, for a given injector, the peak SAC pressures occurring at engine speeds of 5,000 rpm are many times that occurring at 1,000 rpm. Thus, current systems which can only withstand peak SAC pressures of, for example, 12,000 psi, at maximum engine speeds of 5,000 rpm have been forced to manage with SAC pressures at low speed (for example 1,000 to 2,000 rpm of from 2,000 to 4,500 psi. To attain even 8,700 psi at 1,000 rpm could dictate SAC pressures over 70,000 at 5,000 rpm (a pressure greater than anything sustainable by a fuel injector). Thus, for a fuel injector to be successful in increasing the peak SAC pressures achieved under low speed operating conditions, some provisions must be made to prevent the peak SAC pressures occurring under high speed operation (for example, 3,000 to 5,000 rpm) from exceeding the pressures sustainable by the injector.

The desirability of pressurizing the fuel to a substantial level in the low speed operation range without increasing the injection pressure more than necessary in the high speed operation range has been recognized in association with distributor type fuel injection systems having a single centralized high pressure pump and a distributor valve for metering and timing fuel flow from the pump to each fuel injection nozzle; see, for example, U.S. Pat. No. 4,544,097. In such systems, an approach taken for confining the injection pressure to a range lower than a predetermined value has taken the form of a valve member that is acted upon by the injection fuel pressure and which is constructed to relieve fuel pressure by diverting fuel to a lower pressure zone when the fuel pressure level to which the valve is exposed reaches a predetermined value. However, it should be appreciated that if this concept were applied to unit fuel injectors that are designed to operate with precisely metered quantities of fuel, any such bleeding off of fuel from the injection chamber via a fuel pressure responsive valve would make it impossible to maintain the desired precise fuel metering under any operating conditions wherein the relief valve is caused to open. Thus, there is a need for a means which can be utilized in association with unit fuel injectors to achieve pressurizing of the fuel to a substantial level in low speed operational ranges without undesirably elevating the injection pressure in the high speed operational ranges.

DISCLOSURE OF THE INVENTION

In view of the foregoing, it is a general object of the present invention to provide a fuel injector, particularly a fuel injector of the open nozzle type, which is capable of achieving SAC pressures in excess of 30,000 psi during injection. Moreover, within this general object, it is specifically desired to obtain similarly increased SAC pressures, also under low speed operating conditions.

A second object of this invention is to provide a compact unit injector including a plunger assembly having three plungers arranged to form a hydraulic, variable timing fluid chamber between upper and intermediate plungers and an injection chamber below a lower plunger, wherein these plungers are constructed and arranged to enable SAC pressures in excess of 30,000 psi to be obtained without creating leakage or dilation problems.

It is another object of the present invention to provide a fuel injector that is capable of obtaining an increase in obtainable SAC pressures both under low speed and high speed operating conditions by draining timing fluid from the timing chamber whenever the pressure of the timing fluid therein exceeds a predetermined value and, more particularly, to achieve this object via a valve means for opening and closing timing fluid draining passage means.

In keeping with these above objects, still another object of the present invention is to utilize a single spring mounted between intermediate and lower plungers of a three plunger, plunger assembly for biasing the intermediate plunger upwardly, for controlling lifting of the lower plunger and for controlling opening of valve means used for opening and closing passage means for draining timing fluid from a timing fluid chamber formed between the intermediate and upper plungers.

Still a further object of the present invention, for enabling SAC pressures in excess of 30,000 to be achieved during injection, is the attainment of a predetermined minimum seal length, at commencement of injection, between a land portion of an injection plunger and a wall surface defined by a bore of the injector within which the plunger reciprocates, in an area below an output feed orifice of a fuel supply passage, this minimum seal length being coordinated to the dimensions of the bore below the land and a predetermined maximum solid fuel height for the injector at commencement of injection to result in the minimum seal length being at least one-half of the maximum solid fuel height.

These and further objects, features and advantages of the present invention will become more obvious from the following description when taken in connection with the accompanying drawings which show, for purposes of illustration only, several embodiments in accordance with the present invention.

Figure 1:
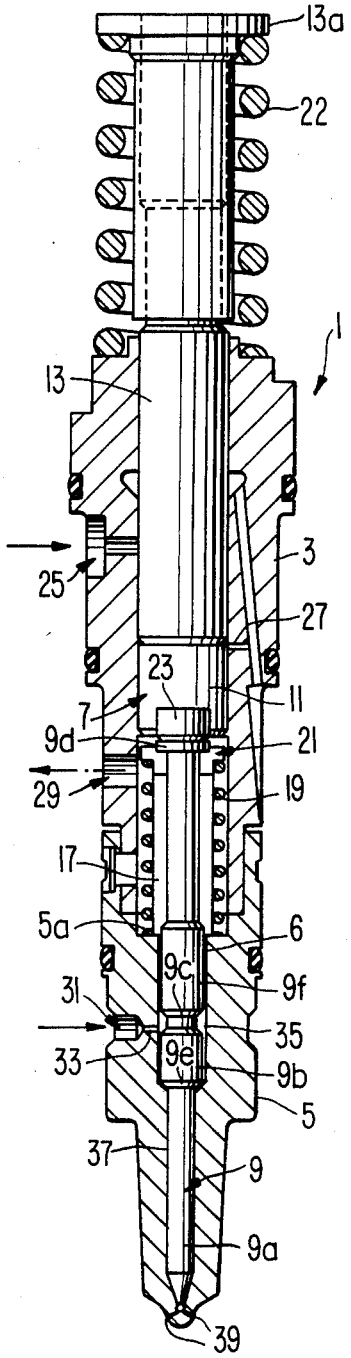
FIG. 1 is a schematic cross-sectional view of a unit fuel injector in accordance with a first embodiment of the present invention.
Figure 5:
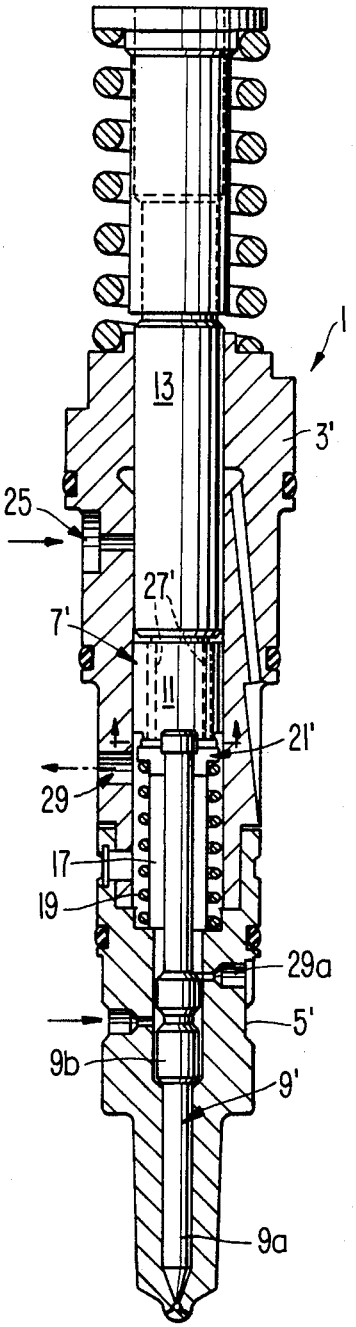
Figure 3:
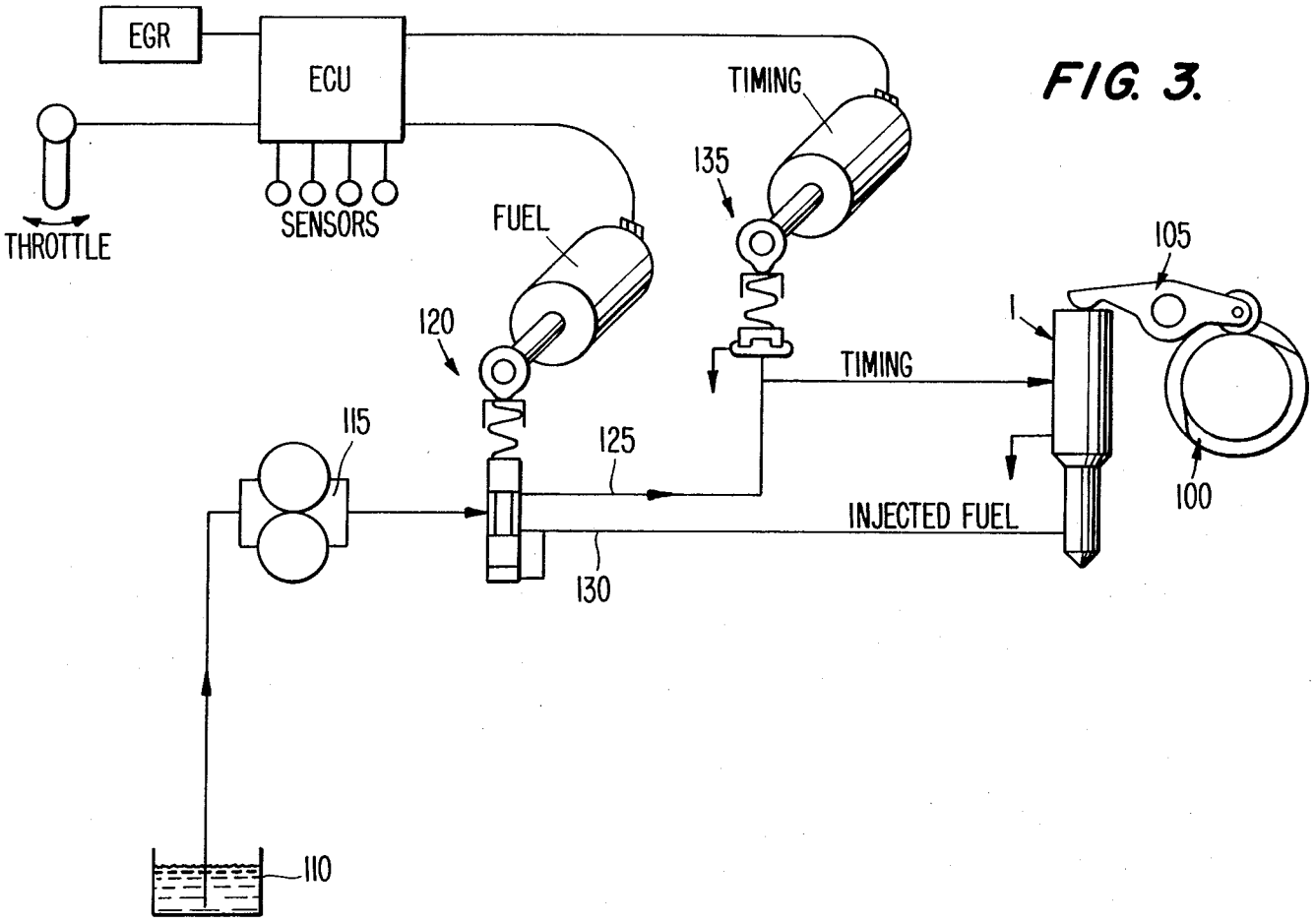
Figure 4:
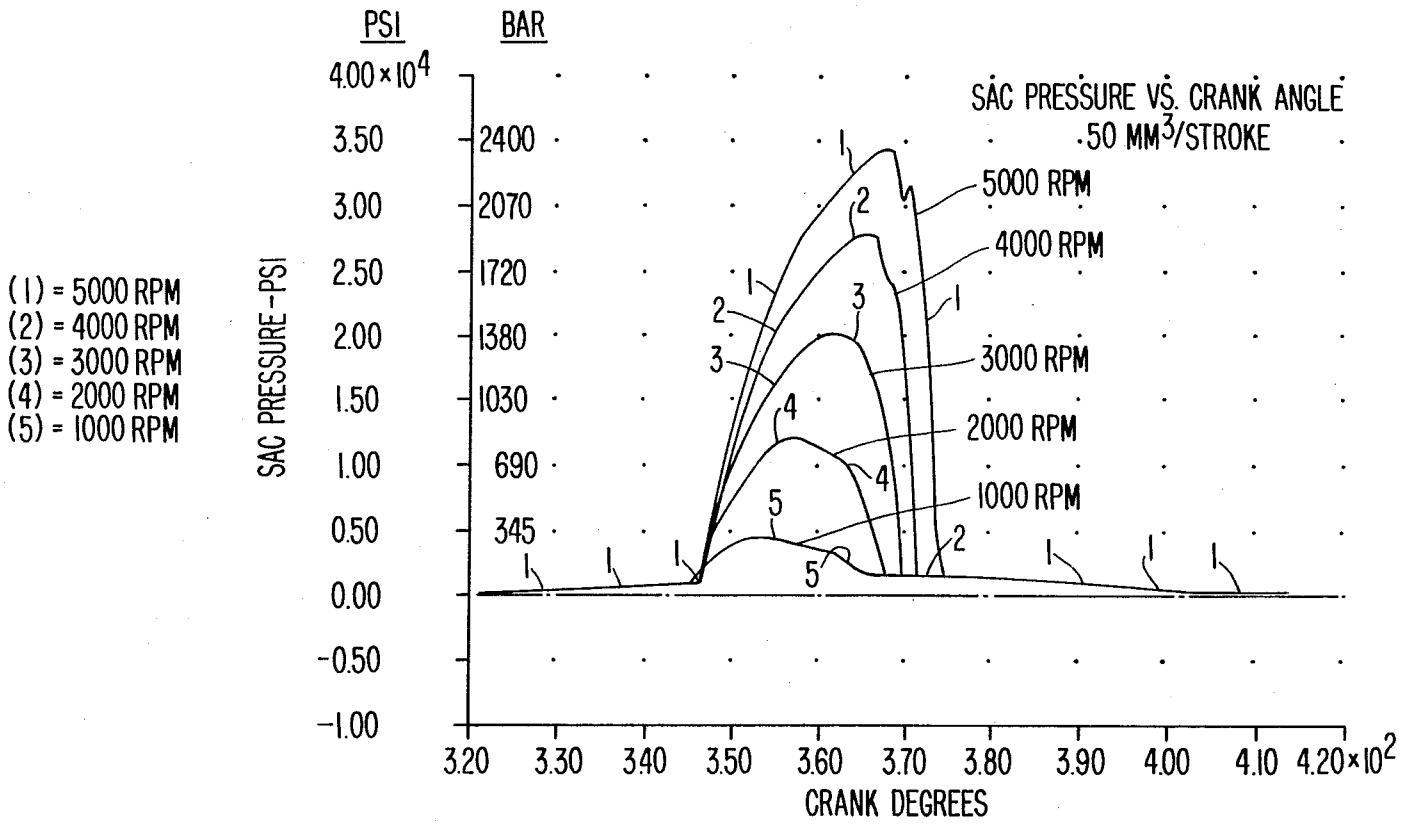
Figure 7:
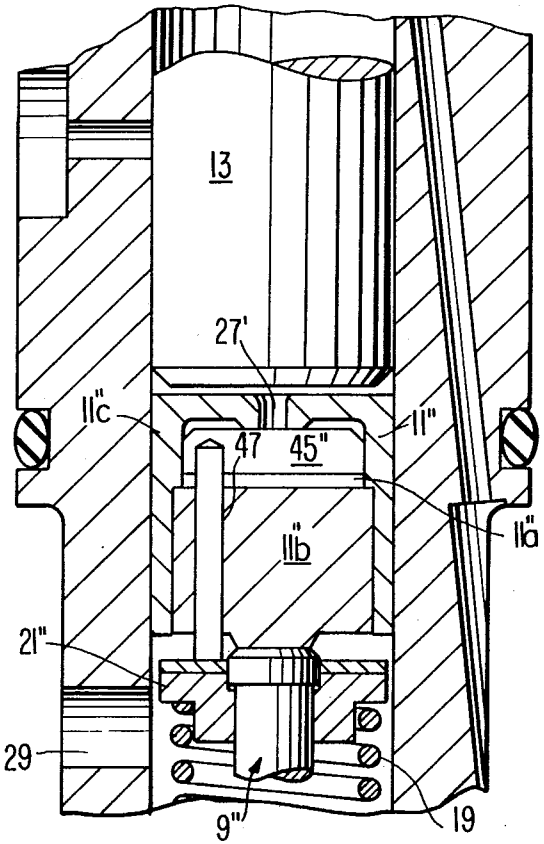
Figure 6:
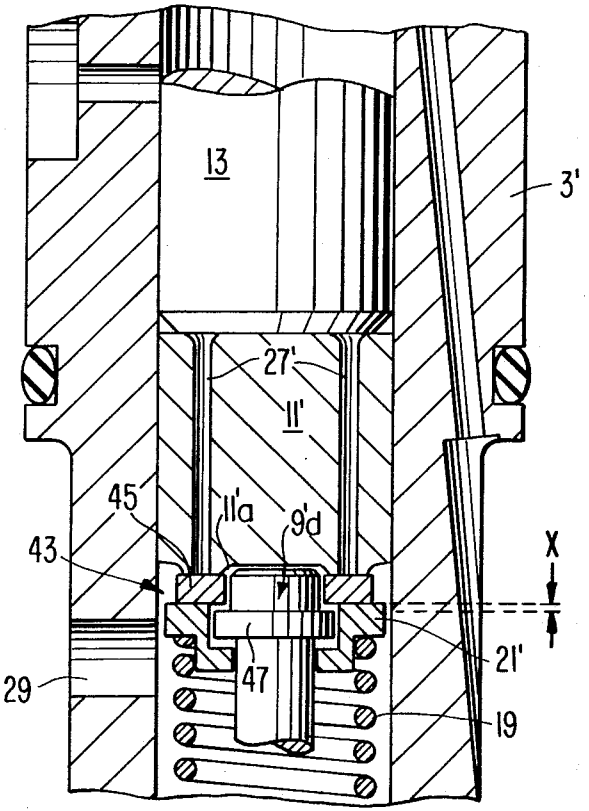
Figure 8:
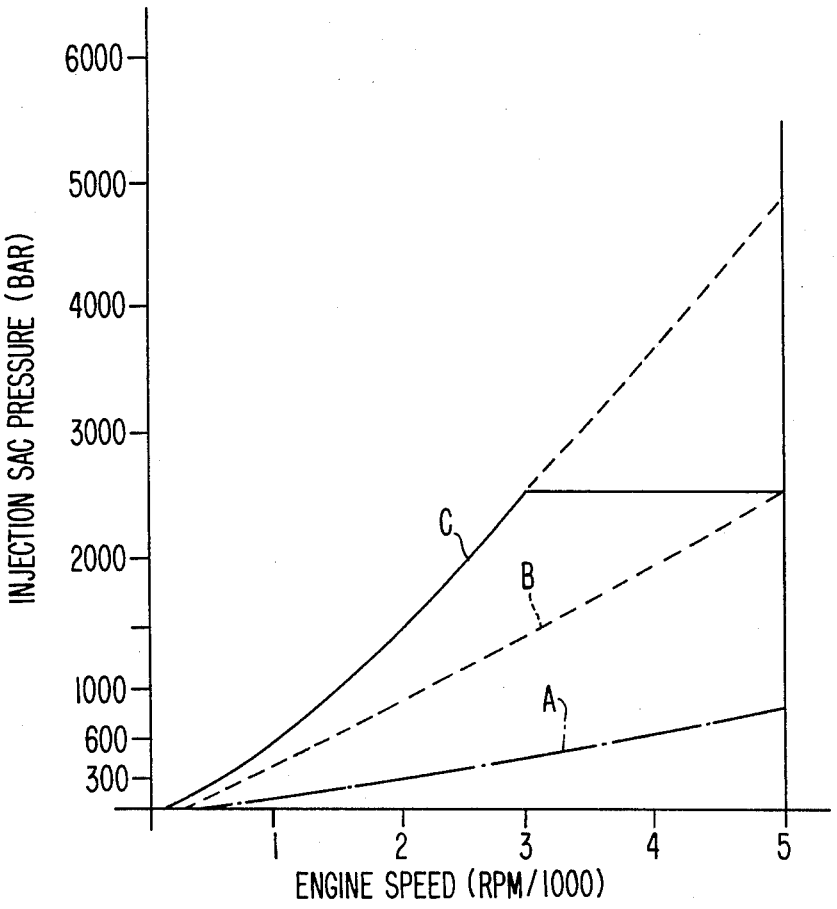

FIGS. *2a–2d* are cross-sectional views of the unit injector of FIG. 1 operating in different phases;

FIG. 3 is a diagrammatic illustration of an electronically controlled fuel injection system incorporating fuel injectors in accordance with the present invention;

FIG. 4 is a graph of SAC pressure verses crank angle for a fuel injector operating at various different speeds;

FIG. 5 is a view, similar to FIG. 1, but illustrating a modified fuel injector in accordance with the present invention;

FIG. 6 is an enlarged view of the injector of FIG. 7 in the area of the intermediate plunger, illustrating a timing fluid draining valve arrangement;

FIG. 7 is a view, simialr to FIG. 8, but illustrating a modified timing fluid draining valve arrangement; and FIG. 8 is a graph of SAC pressure verses engine speed for conventional fuel injectors and fuel injectors in accordance with the present invention.

BEST MODE FOR CARRYING OUT THE INVENTION

FIG. 1 illustrates an open nozzle unit fuel injector designed in accordance with the present invention. In particular, FIG. 1 shows a fuel injector designated generally by the reference numeral 1 which is intended to be received, in a conventional manner, within a recess contained in the head of an internal combustion engine (not shown). The body of the fuel injector 1 is formed of two sections, an injector barrel 3 and a one-piece injector cup 5. Extending axially through the fuel injector is a bore 6 within which is disposed a reciprocating plunger assembly generally designated as 7.

The reciprocating plunger assembly 7 is comprised of three plungers. An injection plunger 9 is the lowermost plunger shown in FIG. 1 and serially arranged above it are an intermediate plunger 11 and an upper plunger 13. A shim 23 is provided in intermediate plunger 11 and permits compensation for the accumulation of dimensional variations which will occur in manufacture in order to correctly position the plunger within the bore 6, as will be more fully described below.

A compensating chamber 17 is formed below intermediate plunger 11. A spring 19 is disposed within compensating chamber 17 and is a coil spring through which the upper end **9*d* of the lower plunger 9 extends. An actuating member 21 engages the underside of upper end 9*d* of injection plunger 9 and the top end of spring 19. The lower end of spring 19 rests upon a seat 5*a* formed on the injector cup 5. In this way, the force of spring 19, via the actuator 21 serves to draw the injection plunger 9 upwardly into engagement with the compensating shim 23 of the intermediate plunger 11 and, thereby, forces the three plunger elements together, from completion of an injection cycle up until metering and timing has commenced for the next injection cycle. In this regard, it is noted that a plunger return spring 22 engages the upper end 13*a* of upper plunger 13 at one end and seats against the top of the injector barrel 3. Return spring 22 biases the upper plunger 13 so as to return it to an uppermost position within bore 6 as such is allowed by the injection cam 100 (FIG. 3), which acts thereon via a rocker arm 105**.

In the first of four stages of each injection cycle, the upper plunger 13 has been retracted sufficiently by the return spring 22 so as to uncover a timing chamber fill passage 25 so that a hydraulic timing fluid (such as fuel) will exert a pressure that will separate the intermediate plunger element 11 from the upper plunger element 13 by causing the compensating spring 19 to compress. The amount of separation of the upper plunger 13 from the intermediate plunger 11 is determined by the equilibrium between the spring force of spring 19 and the force produced by the timing fluid pressure acting on the area of intermediate plunger 11. The greater the separation between plungers 11 and 13, the greater the advance of injection timing.

Figure 2D:
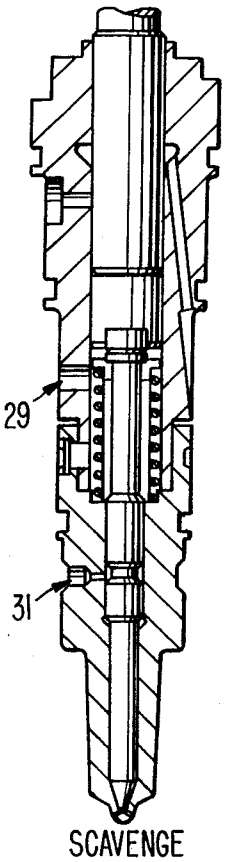
Figure 2C:
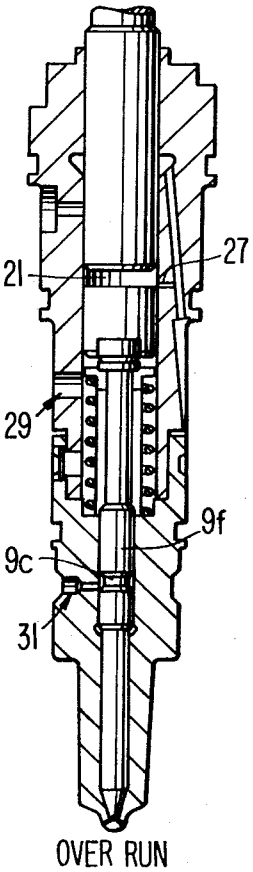
Figure 2B:
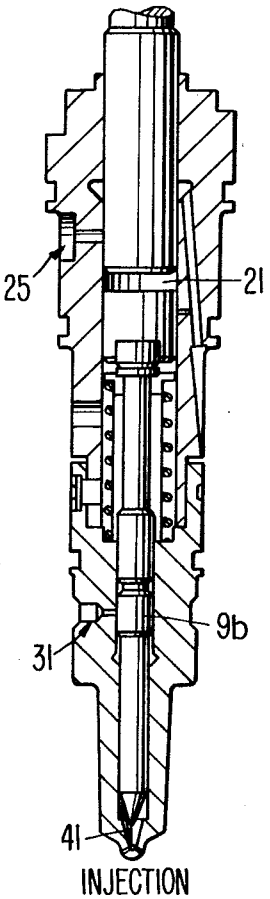
Figure 2A:
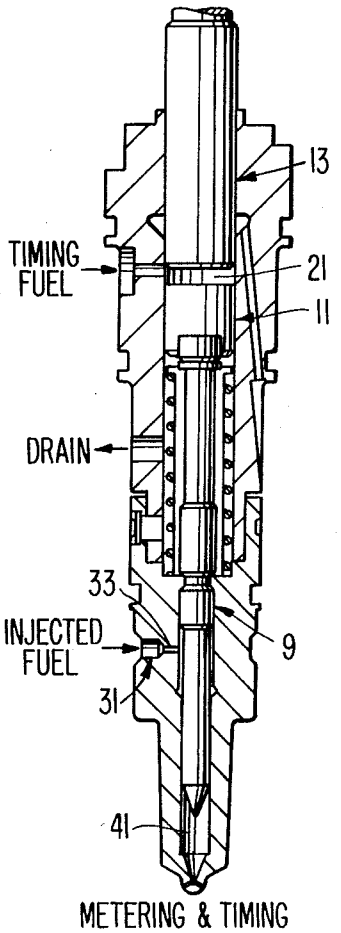

At the same time that the injection timing is being established by the feeding of timing fluid into the timing chamber 21, fuel for injection is caused to flow through an outlet feed orifice 33 of a fuel injector supply passage 31 into the upper portion 35 of injector cup 5 spring 19 having drawn plunger 9 upwardly a sufficient extent for the land portion **9*b* of plunger 9 to have been raised above feed orifice 33. The fuel then passes through a clearance space existing between an elongated lower portion 9*a* of injection plunger 9 and a lower portion 37 of injector cup 5, into injection chamber 41 adjacent the injection orifice openings 39 disposed at the bottom end of injection cup 5. During metering of injection fuel the injection chamber 41 will be partially filled with a precisely metered quantity of fuel in accordance with the known "pressure/time" principle whereby the amount of fuel actually metered is a function of the supply pressure and the total metering time that fuel flows through the feed orifice 33, which has carefully controlled hydraulic characteristics in order to produce the desired pressure/time metering capability. FIG. 2*a*** shows the above noted metering and timeing stage.

In the second stage, the injection stage, the cam 100 causes the upper plunger 13 to be driven down. As a result, timing fluid is forced back out through passage 25 until the timing port is closed by the leading edge of upper plunger 13. At this point, the timing fluid becomes trapped between plungers 11 and 13 forming a hydraulic link which causes all three plunger elements to move in unison toward the nozzle tip. As shown in FIG. **2*b*, the land 9*b* of lower injection plunger 9 closes the outlet feed orifice 33 of injector supply passage 31 as it moves downwardly. However, the fuel previously metered into the injection chamber 41 does not begin to be pressurized until plunger 9 has moved into the injection chamber 41** sufficiently to occupy that part of the injection chamber's volume that was not filled with fuel. The distance measured from this point to the point where downward injection plunger travel is completed is termed the "solid fuel height" and determines the point in the plunger's travel when injection actually begins.

In fuel injectors of the open nozzle type used up to this point, the solid fuel height has been reached at or close to the point at which the feed orifice of the supply passage has been closed by the injection plunger. However, such a characteristic is undesirable for use in injectors, like those of the present invention, which seek to dramatically increase SAC pressures to levels well above those utilized in prior art injectors to over 30,000 psi. Firstly, because of the relatively short distance that fuel needs to leak, at the commencement of injection, from the solid fuel height level to the feed orifice, the degree of sealing produced by such prior art arrangements is insufficient to sustain SAC pressures at the level sought by the present invention without significant leakage occurring. Additionally, the presence of a high pressure chamber in virtually intersecting proximity to the feed orifice a 3.81 stress concentration factor typically caused by the intersecting drilling forming the supply passage.

Both of these problems have been solved, in accordance with the present invention, by ensuring that the minimum seal length, i.e., the axial distance between the orifice 31 and the leading edge **9*e* of land 9*b*, occurring at commencement of injection, is equal to at least one half of the solid fuel height. By maintaining such a minimum seal length relationship, not only can SAC pressures as high as 35,000 psi be maintained, but also the high pressure chamber will be displaced sufficiently away from the intersecting drilling forming the supply passage 31** that the stress concentration factor (which can lead to fatigue failure of the injector) is removed.

Also, it is noted that the present invention enables high SAC pressures to be achieved, without leakage, and without requiring high clamping pressures as well. That is, in the past, the injection fuel supply passage was formed in the barrel element of the injector body not in the injector cup. Thus, an interface between the injector barrel part and the injector cup existed below the feed orifice, and the presence of such a clamped high pressure joint limited the injection pressure capabilities. In accordance with the present invention, however, no such clamped high pressure joints are necessary since, due to the three plunger design of the present invention, it is practical to actually form the injection supply passage within the injector cup because it is possible to elongate the injector cup portion and shortened the injector body barrel portion relative to those shown in the initially mentioned patents of the present assignee, and because the joint between the injector barrel 3 and injector cup 5 can be situated in a region of low pressure at chamber 17. In this regard, it is noted that, while it is possible for the one-piece injector cup to be made of a single piece of material, it is within the scope of the present invention to form a one-piece cup via the permanent unification of separate metal components, such as by welding. However, the latter unification is less desirable due to the problems and expenses associated with producing a welded joint sufficient to sustain injector operating conditions.

Additionally, it is noted that achievement of SAC pressures above 30,000 psi requires more than consideration of the sealing capacity of the lower end of the injector at which metering and injection of the fuel occurs. That is, since the pressure for injection of the fuel is transmitted from the upper plunger 13 via the hydraulic timing arrangement to the lower plunger and since, in conventional systems, the diameter of the plunger assembly acting upon the timing fluid is coequal to that acting upon the fuel to be injected, attainment of SAC pressures in excess of 30,000 psi would require the timing chamber also to sustain such pressure levels. Likewise, a dramatic increase in the injector drive train mechanical loads would also occur and have to be compensated for.

Such problems, however, are avoided by way of the three plunger assembly of the present invention since the elongated lower plunger 9 is made significantly smaller in diameter than the intermediate and upper plungers 11 and 13 (which are of the same diameter). Thus, the load to which the timing fluid is subjected. for example, can be much lower (one quarter of that in the ignition chamber) and thus much more easily sustained than the pressures to which the fuel in the injection chamber 41 are subjected. A lower timing fluid pressure also permits a large return force to be applied. Use of a separate smaller injection plunger 9, also, provides the advantage that there is no longer a requirement for precise concentricity of the portion of bore 6 within which plungers 11 and 13 reciprocate with respect to the laser diameter lower portion within which plunger 9 is received.

Injection ends sharply when the tip of the plunger element *9a* contacts its seat in the nozzle tip as shown in FIG. *2c*. At this time, a third, overrun, stage is produced wherein the hydraulic link between plungers 11 and 13 is collasped. That is, the timing chamber draining passage 27 is opened by the upper edge of intermediate plunger 11 passing below the top of the timing chamber draining passage, which occurs just before the plunger 9 seats in the nozzle tip. During this stage, plunger 13 continues to move downward forcing the timing fluid out from the timing fluid chamber 21. In this regard, it is noted that the flow resistance of passage 27 is chosen to ensure that the pressure developed in the collapsing timing chamber 21, between plungers 11 and 13, is sufficient to hold injection plunger 9 tightly against its seat, preventing secondary injection. In this regard, it is again noted that the shim 23 provides a very simple means by which the accumulation of dimensional variations in the plungers can be compensated for in order to correctly control the point in the plunger travel at which the timing chamber drain passage 27 will open.

FIG. *2d* shows the injector after all of the timing fluid has been drained so that the plungers 11 and 13 no longer are separated. At this point, the entire injection train, from the injection cam to the nozzle tip, is in solid mechanical contact. Initial adjustment of the injector, made during installation, provides the force necessary to prevent any after-injection, until the cycle is repeated, during the engine's next induction stroke.

In both the overrun and scavenge stages (FIG. *2c, 2d*) scavenging of the system of gases and cooling of the injector is produced. In particular, when injection has ended by the plunger 9 seating in the nozzle tip, a relieved groove *9c* in land portion *9b* of the plunger 9 is brought into communication with fuel supply passage 31 so that fuel may pass through this groove *9c* to an axially relieved portion *9f* of land *9b*, along which the fuel travels up into compensating chamber 17 and then out of the injector body via injector drain port 29.

FIG. 3 diagrammatically depicts an electronically controlled injection system for supplying the timing fluid and fuel to be injected to an injector in accordance with the present invention. As shown, fuel is drawn from a reservoir 110 by a fuel pump 115. An electronic control unit ECU monitoring throttle position, and the output of sensors measuring such factors as engine temperature, emissions, and the like operates an electronically controlled fuel supply valve arrangement 120 which regulates the supplying of fuel to supply rails 125, 130 associated with a plurality of injectors of an engine, and also controls the pressure of the fluid in the timing rail 125 via an electronically actuated pressure controller arrangement 135.

Turning now to FIG. 4, the relationship between SAC pressure and crank angle, at increments of 1,000 rpm, between 1,000 and 5,000 rpm, for a small displacement, high speed diesel engine can be seen. As these results show, when peak SAC pressures between 4,000 and 5,000 psi are attained at 1,000 rpm, peak SAC pressures of between 34,000 and 35,000 psi are attained at 5,000 rpm. Thus, even with the ability of the present invention to sustain SAC pressures of 35,000 psi, severe limitations are imposed on the SAC pressures that are achievable under low speed operating conditions. Furthermore, as noted initially, it has already been recognized that there is a need to produce a substantial increase in injection pressures during low speed operation for the purpose of controlling emissions but, further increases beyond that depicted in FIG. 4 would exceed even the dramatically improved pressure sustaining capabilities of the fuel injector in accordance with the present invention as described with reference to the FIG. 1 embodiment of the present invention. As also noted in the background portion of this application, in distributor type fuel injection systems, an approach has been taken whereby an relief valve is utilized to bleed fuel from the injection nozzle if injection fuel pressures exceed a predetermined value. Of course, such a system could not be utilized in a unit fuel injector, designed to inject precisely metered quantities of fuel, without adversely affecting the ability to control the amount of fuel injected under any operating conditions wherein such a valve would open.

On the other hand, it has been found to be possible, in accordance with modified embodiments of the present invention, to attain a substantial increase in SAC pressures in the low speed operational range (to near what had been the maximum under high speed operation conditions in more conventional injectors of this type)

without exceeding the operational pressure capabilities of the injector in the high speed range.

FIGS. 5 and 6 illustrate a modified version of the FIG. 1 injector wherein common, but unchanged components bear the same reference numerals and like, but modified, components bear a prime designation.

Firstly, with reference to FIG. 5, it can be seen that the injector barrel 3' differs from injector 3 of FIG. 1 in that timing chamber draining passage 27 has been eliminated, draining of the timing chamber occuring instead via at least one timing chamber draining passage 27' formed in intermediate plunger 7'. Thus, in a manner to be described in greater detail, below, the timing fluid is drained from the timing chamber via the timing chamber draining passage means in the intermediate piston 7' into the compensating chamber 17 and out via the injector drain portion 29. Accordingly, injector cup 5' is provided with a separate injector drain port **29*a* for the scavenging flow occurring during the overrun and scavenge stages described with reference to FIGS. 2*c*, *d*. However, it is noted that the addition of such a separate drain port 29*a* is purely optional for use in this embodiment, on the one hand, and may be added to the FIG. 1** embodiment, optionally, on the other hand.

The only other structural difference between the FIG. 1 and FIG. 5 injectors is the provision of valve means 43 (shown in greater detail in FIG. 6) for controlling the draining of timing fluid from the timing chamber 21 via the passages 27'. In particular, valve means 43 comprises a valve disc 45, which may be attached to or integral with actuating member 21'. the end **9'*d* of plunger 9' is provided with an enlarged stop means 47 upon which the valve means is carried so that it may execute a predetermined axial displacement X relative to stop member 47 in a direction away from intermediate plunger 11'. Valve means 43 sealingly engages against a raised valve seat 11'*a* formed on the facing lower side of plunger 11' under action of the compensation spring 19 during the timing and metering phase of FIG. 2*a*. Metering of the fuel for injection and separation of the plungers 11', 13 for timing occurs in this embodiment in the same manner as described with regard to the embodiment of FIG. 1. Likewise, the injection process begins in the same manner as described for the first embodiment. In this case, the fuel in the timing fluid chamber 25 is trapped by the valve means 43, which is forced against the lower surface of plunger 11' by the spring 19**.

So long as injection pressure remains less than a preset value determined by spring 19, injection continues normally until it is ended sharply by the seating of plunger 9' in the nozzle tip. At this point, the pressure in timing fluid chamber 25 rises to a level sufficient to unseat the valve means 43, thereby allowing the fuel to drain from timing chamber 25 via the timing chamber draining passages 27' to the drain portion 29 via the compensation chamber 17. Furthermore, the valve means 43 regulates the pressure in the hydraulic link formed by the timing chamber and plungers 13, 11' to prevent uncontrolled collapse and secondary injection. On the other hand, if during the injection cycle the injection pressure exceeds the preset value when the plunger 13 is still being driven toward the nozzle tip, the pressure in the timing chamber between the plungers 11' and 13 will overcome the sealing pressure exerted by the compensating spring 19, thereby allowing fuel to escape from the hydraulic link to the drain port 29 via passages 27'. In this case, the valve means 43 serves to regulate the pressure in the collapsing hydraulic link so that the injection is completed at pressures which are close to the preset maximum. This pressure regulating action of the valve means 43 also ensures that the duration of injection is minimized and the injection ends sharply, without secondary injection.

Apart from the above described factors, the remainder of injector 1' and the remainder of its injection cycle is the same as described with respect to the embodiment of FIG. 1.

FIG. 7 shows a modified pressure regulating valve arrangement in accordance with the present invention. In this embodiment, the intermediate plunger 11'' is hollow and has a single, central, draining passage in its top wall. Draining passage 27'' communicates with a hollow interior space **11''*a* formed by the insertion of a plunger plug portion 11''*b* into a cup shaped plunger shell portion 11'*c*. In this case, the valve means for opening and closing the draining passage 27'' comprises a valve disc 45'' that is positioned for reciprocation within the chamber 11''*a* under action of three or more equi-angular spaced actuating pins 47 (only one of which is shown) that are carried on the end of plunger 9'' by the actuating member 21''. The valve disc 45'' is held in the illustrated closed position by the action of compensating spring 19 and it is shifted therefrom in the same manner and under the same conditions as described with respect to the embodiment of FIGS. 5 and 6. The axial extent of the relative displacement of valve disc 45'' is limited to a predetermined value dictated by the distance between the underside of disc 45'' and the top surface of plunger plug portion 11''*b*. Similarly, all other aspects of the construction and operation of an injector including this modified pressure regulating valve arrangement of FIG. 7** correspond to that described above with respect to the other embodiments.

It will be appreciated, also, that numerous other pressure regulating valve arrangements can be produced which will function in the same manner as those shown in FIGS. 5–7 for purposes of draining the timing fluid from the timing chamber when injection pressures above a predetermined value occur. Additionally, timing fluid draining valve means used as an injection pressure limiting mechanism in accordance with the present invention achieve several advantages even with respect to the injector of FIG. 1. Firstly, the need for formation of a timing fluid drain passage in the barrel portion of the injector body is eliminated and thus the need for maintaining precise tolerance for the timing fluid draining passage is eliminated. Secondly, the shim 23 is no longer required for compensation of dimensional variations. Most importantly, is the fact that the use of a pressure regulating valve means in accordance with the present invention enables the maximum injection pressure to be limited to a preset value which permits the use of a faster injection cam lift than would be possible, for example, with the embodiment of FIG. 1. Faster injection cam lift increases injection pressures of low engine speeds, while the pressure regulating valve means prevents excessive injection pressures at high engine speeds. Additionally, use of a spring that is compressed when the valve opens has the benefit that valve closing occurs at a higher pressure than valve opening and produces the desirable effect of causing more of the fuel to be injected at the end of the stroke when the fuel is burning best.

FIG. 8 shows a comparison between current fuel injectors, a fuel injector in accordance with the FIG. 1 embodiment, and a fuel injector in accordance with the embodiments of FIGS. 5–7 in a plot of injection SAC pressure verses engine speed. In FIG. 8, curve A represents current systems, curve B represents the FIG. 1 embodiment and curve C represents embodiments in accordance with FIGS. 5–7. As can be seen, the FIG. 1 embodiment attains a dramatic increase in SAC pressures relative to current systems. Furthermore, through use of the pressure regulating valve means in accordance with the present invention, SAC pressures below the maximum speed can be dramatically raised still further, without further increasing the maximum injection SAC pressures occurring.

While I have shown and described various embodiments in accordance with the present invention, it is understood that the same is not limited thereto, but is susceptible of numerous changes and modifications as known to those skilled in the art, and I, therefore, do not wish to be limited to the details shown and described herein, but intend to cover all such changes and modifications as are encompassed by the scope of the appended claims.

INDUSTRIAL APPLICABILITY

A fuel injector designed in accordance with this invention would find application in a large variety of internal combustion engines. One particularly important application would be for small compression ignition (diesel) engines adapted for powering automobiles. Lighter truck engines and medium range horsepower engines could also benefit from the use of injectors designed in accordance with the subject invention.

I claim

1. A periodic fuel injector, comprising
(a) an injector body containing a central bore and an injection orifice at the lower end of the body,
(b) metering means for metering a variable quantity of fuel for injection through said injection orifice on a periodic basis dependent upon the pressure of fuel supplied to said injector body, said metering means including a lower plunger mounted for reciprocal movement within said central bore
(c) hydraulic timing means for varying the timing of each periodic injection of metered fuel dependent upon the pressure of a hydraulic timing fluid supplied to said injector body, said hydraulic timing means including an upper plunger mounted for reciprocal movement within said central bore and an intermediate plunger mounted for reciprocal movement within said central bore between said upper and lower plungers, said timing fluid being supplied to a timing fluid chamber between said upper and intermediate plungers;
(d) valve means for opening and closing passage means for draining timing fluid from said timing fluid chamber; and
(e) a spring mounted in said central bore and acting upon said lower plunger as a means for biasing said intermediate plunger upwardly, for controlling lifting of said lower plunger, and for controlling opening of said valve means.

2. A fuel injector according to claim 1, wherein said passage means comprises at least one passage communicating said timing fluid chamber with a drain passage in said injector body via a low pressure chamber formed at the opposite side of said intermediate plunger from said timing fluid chamber.

3. A fuel injector according to claim 2, wherein said at least one passage is formed in said intermediate plunger.

4. A fuel injector according to claim 3, wherein said valve means is disposed in said low pressure chamber.

5. A fuel injector according to claim 4, wherein said valve means is relatively displaceably mounted to an upper end of said lower plunger for movement in directions parallel to the directions of the reciprocal movement of said plungers.

6. A fuel injector according to claim 5, comprising stop means for limiting the extent of relative movement of said valve means.

7. A fuel injector according to claim 6, wherein said stop means are carried by said lower plunger.

8. A fuel injector according to claim 6, wherein said passage means comprises a plurality of passages extending through said intermediate plunger and said valve means is a valve disc that is sealingly engageable against said intermediate plunger for closing said passages under the action of said spring.

9. A fuel injector according to claim 3, wherein said valve means is disposed within intermediate plunger.

10. A fuel injector according to claim 9, wherein said valve meas is relatively displaceably mounted to an upper end of said lower plunger for movement in directions parallel to the directions of the reciprocal movement of said plungers.

11. A fuel injector according to claim 10, comprising stop means for limiting the extent of relative movement of valve means.

12. A fuel injector according to claim 11, wherein said valve means comprises a valve disc disposed within a valve chamber formed in said intermediate plunger, an actuating member carried upon an upper end of the lower plunger and connecting pins extending from the actuating member, through a bottom portion of the intermediate plunger, into engagement with said valve disc, said spring acting upon said actuating member in a direction for biasing said valve disc into a position sealingly closing a passage extending from the timing fluid chamber to the valve chamber.

13. A fuel injector according to claim 1, wherein said valve means comprises a valve disc disposed within a valve chamber formed in said intermediate plunger, an actuating member carried upon an upper end of the lower plunger and connecting pins extending from the actuating member, through a bottom portion of the intermediate plunger, into engagement with said valve disc, said spring acting upon said actuating member in a direction for biasing said valve disc into a position sealingly closing a passage extending from the timing fluid chamber to the valve chamber.

14. A fuel injector according to claim 1, wherein said valve means is relatively displaceably mounted to an upper end of said lower plunger for movement in directions parallel to the directions of the reciprocal movement of said plungers.

15. A fuel injector for periodically injecting fuel of a variable quantity on a cycle to cycle basis as a function of the pressure of fuel supplied to the injector from a source of fuel and at a variable time during each cycle as a function of the pressure of a timing fluid supplied to the injector from a source of timing fluid, comprising:
(a) an injector body containing a central bore and an injector orifice at the lower end of the body;

(b) a reciprocating plunger assembly including an upper plunger and a lower plunger mounted within said central bore to define (1) a variable volume injection chamber located between said lower plunger and the lower end of said injector body containing said injection orifice, said variable volume injection chamber communicating during a portion of each injector cycle with the source of fuel, (2) a variable volume timing chamber located below said upper plunger, said timing chamber communicating for a portion of each injector cycle with the source of timing fluid; and (c) means for attaining maximized SAC pressures under both low speed and high speed operating conditions by draining timing fluid from said timing chamber whenever the pressure of the timing fluid in said timing chamber exceeds a predetermined value during an injection stroke movement of said lower plunger toward said injection orifice.

16. A fuel injector according to claim 15, further comprising an intermediate plunger mounted within said central bore between said upper and lower plungers, a variable volume compensation chamber located between said intermediate and lower plungers; and bias means located within said variable volume compensating chamber for biasing said intermediate and lower plungers.

17. A fuel injector according to claim 16, wherein said means for attaining comprises valve means for opening timing chamber draining passage means in response to an opening pressure corresponding to said predetermined value and for reclosing said timing chamber draining passage means at a closing pressure that is higher than said opening pressure.

18. A fuel injector according to claim 17, wherein said biasing means is a spring, said valve means acting to compress said spring as it moves from a position closing the timing chamber draining passage means in response to the pressure of the timing fluid within the timing chamber.

19. A fuel injector according to claim 15, wherein said means for attaining comprises valve means for opening timing chamber draining passage means in response to an opening pressure corresponding to said predetermined value and for reclosing said timing chamber draining passage means at a closing pressure that is higher than said opening pressure.

20. A fuel injector according to claim 19, wherein a spring is provided for biasing the valve means into a closed position in a manner that is valve means acts to compress said spring as it moves from a position closing the timing chamber draining passage in response to the pressure of the timing fluid in the timing chamber.

21. A fuel injector of the open nozzle type for periodically injecting fuel of a variable quantity on a cycle to cycle basis at high pressure comprising:

(a) an injector body having a one-piece injector cup containing an axial bore with a fuel supply passage extending through an upper portion of the injector cup for communicating said axial bore with a supply of fuel, and an injection orifice at the bottom of a lower portion thereof for delivering fuel from the injector, said axial bore having a larger diameter in said upper portion than in said lower portion;

(b) a reciprocating plunger assembly having a solid injection plunger mounted for reciprocation within the axial bore, said injection plunger being provided with an elongated lower portion of a diameter corresponding to that of the axial bore in said lower portion and a radially enlarged land above said lower portion of a diameter closely matched to that of the axial bore in said upper portion, and said plunger being reciprocal within said axial bore from raised positions wherein said land portion is above said supply passage for metering of fuel into an injection chamber defined in said bore below said plunger, through intermediate positions wherein said land portion blocks metering of fuel from said supply passage into said injection chamber, to a lowermost position at which said injection orifice is closed by the bottom end of said lower portion of the injection plunger;

wherein, for enabling SAC pressures in excess of 30,000 psi to be achieved during injection, a predetermined minimum seal length is attained, at commencement of injection, between said land portion and a wall surface defining said bore in an area of said upper portion located below an outlet feed orifice of the supply passage, said minimum seal length being coordinated to the dimensions of said bore below said land and a predetermined maximum solid fuel height for said injector at commencement of injection so as to be equal to at least one-half of the solid fuel height.

* * * * *